United States Patent [19]

Hiraoka

[11] 4,379,492

[45] Apr. 12, 1983

[54] TORQUE CONTROL APPARATUS FOR PNEUMATIC IMPACT WRENCH

[75] Inventor: Masaaki Hiraoka, Yao, Japan

[73] Assignee: Nippon Pneumatic Manufacturing Co., Ltd., Osaka, Japan

[21] Appl. No.: 155,084

[22] Filed: Jun. 2, 1980

[30] Foreign Application Priority Data

Jun. 4, 1979 [JP] Japan ..... 54-71687

[51] Int. Cl.[3] ..... B25B 23/145

[52] U.S. Cl. ..... 173/12; 81/470; 137/834

[58] Field of Search ..... 173/12; 137/834; 81/470

[56] References Cited

U.S. PATENT DOCUMENTS

| | | | |
|---|---|---|---|
| 3,122,165 | 2/1964 | Horton | 137/834 X |
| 3,180,346 | 4/1965 | Duff | 137/834 X |
| 3,238,960 | 3/1966 | Hatch, Jr. | 137/835 X |
| 3,628,774 | 12/1971 | Sudich | 137/835 X |
| 3,948,328 | 4/1976 | Hiraoka et al. | 173/12 |

*Primary Examiner*—Robert Mackey

*Attorney, Agent, or Firm*—Wenderoth, Lind & Ponack

[57] ABSTRACT

The invention relates to a control apparatus for a pneumatic impact wrench driven by an air motor. The pneumatic impact wrench according to the invention comprises a torsion bar, a spindle case, an orifice-shaped rotation suspending valve adapted to narrow or close an exhaust port provided on the torsion bar when the torsion bar is twisted, a pneumatic double-acting main valve adapted to be opened and closed by diaphragms provided intermediately in a passage for supplying compressed air to the air motor, a fluidic element connected to a pilot passage communicating with the control side of the main valve, a conflux pipe and a control valve, the conflux pipe being caused to communicate with one of the control orifices of the fluidic element through a small diameter hole, the other control orifices of the fluidic element being adapted to operate in association with a throttle valve for supplying compressed air to the air motor so as to instantaneously open when the throttle valve opens and closes, thereby communicating with a communication passage leading to the control valve. The torque control apparatus according to the invention is characterized in that two outputs of the fluidic element are caused to communicate with the diaphragms on both sides of the main valve respectively, a second throttle valve being provided in a passage communicating with the input of the fluidic element.

3 Claims, 3 Drawing Figures

TORQUE CONTROL APPARATUS FOR PNEUMATIC IMPACT WRENCH

BACKGROUND OF THE INVENTION

The invention relates to a torque control apparatus for a pneumatic impact wrench driven by an air motor. The apparatus according to the invention makes it possible to simplify the control mechanism of compression torque, to control it with precision, and to change the control valve with ease, by providing a fluidic element and a torsion bar in a pneumatic impact wrench.

A pneumatic impact wrench provided with such torque control apparatus has already been disclosed in the U.S. Pat. No. 3,948,328.

In the torque control apparatus according to the said prior art, however, a spring-system reducing valve was used intermediately in an air passage communicating with an inlet of the fluidic element. Such spring-system reducing valve had a disadvantage in that the air pressure supplied to the fluidic element was unstable due to vibrations of the valve body through the elasticity of the springs.

Moreover, the main valve for intercepting the supply of air to the air motor was adapted to recover also by the force of springs. Due to high resistance of the springs, it occasionally happened that the valve could not be actuated by a small outlet pressure of the fluidic element. The conventional apparatus, therefore, had a further disadvantage in that the operation of the main valve was unstable.

BRIEF SUMMARY OF THE INVENTION

The invention has for an object to completely eliminate the aforesaid disadvantages of the conventional apparatus and provide a novel apparatus wherein the air pressure supplied to the fluidic element is reduced by means of a dropping resistor, and the supply and interception of air to the air motor is controlled by means of double-acting valve without recourse to springs thereby enabling a stable operation to be obtained by the air pressure from the two output ports of the fluidic element.

BRIEF DESCRIPTION OF THE DRAWINGS

The accompanying drawings show an embodiment of a pneumatic impact wrench according to the invention, in which.

DETAILED DESCRIPTION OF THE PREFERRED EMBODIMENT

Figure 1:
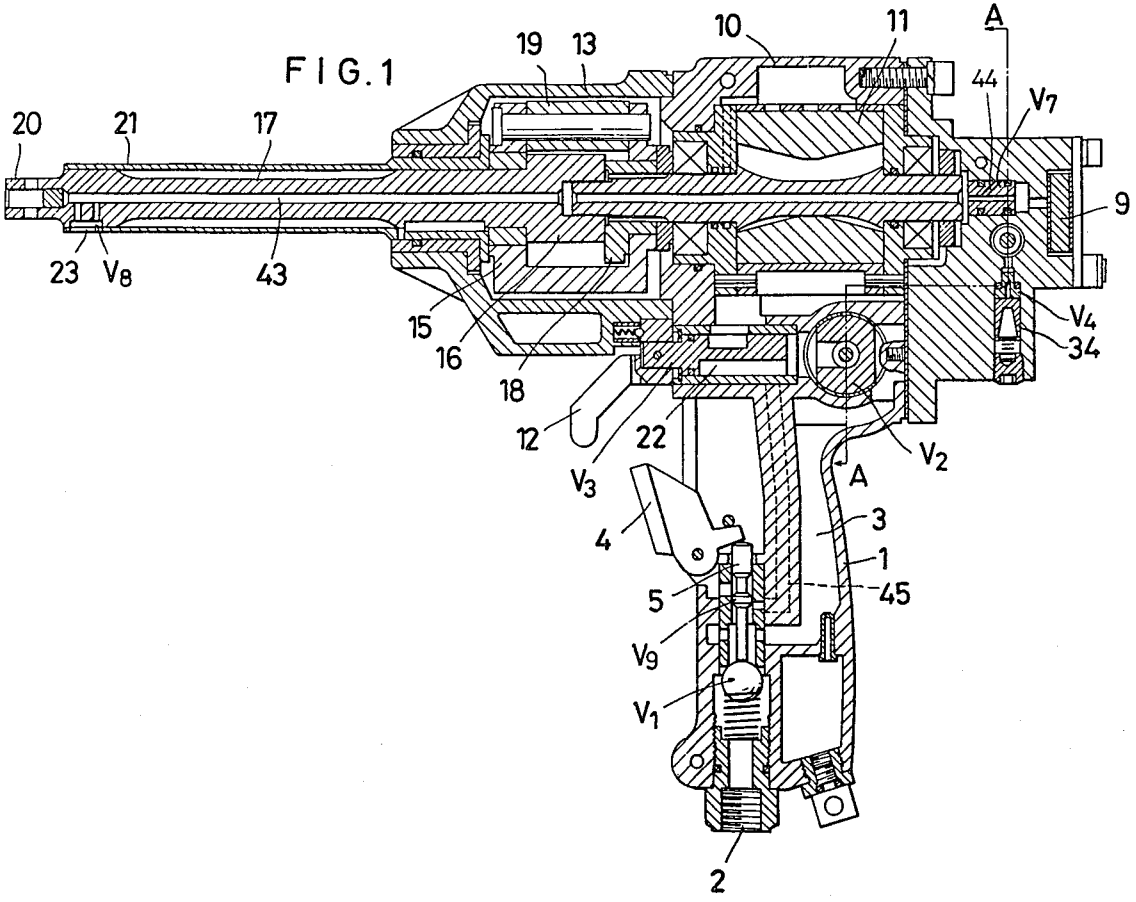
FIG. 1 is a longitudinal sectional side view of a pneumatic impact wrench.

Referring to the drawings, the numeral 1 designates a handle of the pneumatic impact wrench provided with an air inlet 2 and an air passage 3. A slide shaft 5 operable by a lever 4 pivotally mounted on the handle 1 is in contact with an inlet valve $V_1$ provided between the inlet 2 and the air passage 3. The valve $V_1$ closes its opening under the urging of a spring and air pressure when the lever 4 is not pressed, while it opens its opening under the pressure of the slide shaft 5 when the lever 4 is pressed.

There is provided a control valve $V_9$ for establishing and blocking communication between passage 3 and a pilot passage 45 in the handle 1, control valve V9 being adapted to block communication between the passage 3 and the pilot passage 45 when the slide shaft 5 is pressed downwardly by the lever 4, while maintaining the communication therebetween when the slide shaft 5 is elevated free from pressure.

In the base part of the handle 1 there are provided a main valve $V_2$ and a dropping resistor (throttle valve) $V_4$, a fluid element 9 being secured to the rearward portion of the case.

The fluidic element 9 is of the type available on the market; a flipflop type fluidic element made by Corning Fluidic Products, Inc., U.S.A. in the case of the invention. This fluidic element has one inlet, two control orifices and two outlets. It is so adapted that the air supplied through the inlet can be sent to either of the two outlets, the direction being switchable by applying a very small amount of fluid (e.g. air) to the right-hand or left-hand control orifice for a short time, thereafter the air being continuously sent to the switched outlet exclusively until the fluid is supplied to the other control orifice by the same procedure. This is the application of the Coanda effect.

Above the handle 1 is provided a case 10 in which an air motor 11 is mounted. In the lower part of the case 10 is provided a rotating direction switch valve $V_3$ of the air motor 11, the said valve $V_3$ being manually operable by means of a lever 12.

The numeral 13 designates a hammer case secured to the forward portion of the case 10, a hammer frame 15 being rotatably provided in hammer case 13, an anvil 16 being rotatably provided in the center of the frame 15, a torsion bar 17 integral with the anvil 16 being provided in the forward portion of the anvil 16 so that the anvil 16 and the torsion bar 17 are integrally rotatable. A driver 18 is rotatably fitted into the rearward portion of the hammer frame 15, driver 18 being connected by a spline to the rotor spindle of the said air motor 11. Hammer frame 15 is axially fixed with a hammer 19. When the torsion bar 17 is scarcely affected by resistance, it rotates continuously with the rotation of the rotor of the air motor 11 transmitted to the driver 18, the anvil 16 and the torsion bar 17 in that order. However, when the resistance applied to the torsion bar 17 is so strong as to stop its rotation, an impact is applied to the stopping anvil 16 by the rotating driver 18 and the hammer 19 thereby urging the torsion bar 17 to rotate despite the applied resistance. Various known devices are applicable to the impact mechanism of this type. At the forward end of the torsion bar 17, there is provided an insertion part 20 for receiving various sockets conformable with bolts or nuts for fastening, the forward portion of the spindle case 21 being disposed so as to overlap the base of insertion part 20 while the rearward end thereof is secured to the torsion bar 17. The spindle case 21 has a rigid body and is externally fitted onto the torsion bar 17 so as to be rotatable (elastically twistable) relative to the torsion bar 17 except the rearward end thereof. An orifice-shaped rotation suspending valve $V_8$ is formed at the forward end of the spindle case 21, an exhaust port 23 coinciding with the valve $V_8$ being provided on the torsion bar 17 so that the valve $V_8$ and the exhaust port 23 coincide with each other when the torsion bar 17 is not distorted (twisted), while the valve $V_8$ is dislocated from the exhaust port 23 when the torsion bar 17 is distorted.

Figure 2:
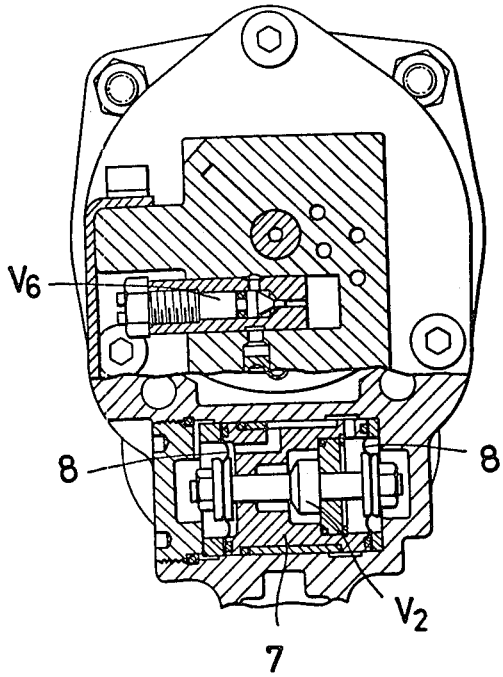
FIG. 2 is a sectional view, on a magnified scale, taken along the line A—A of FIG. 1.
Figure 3:
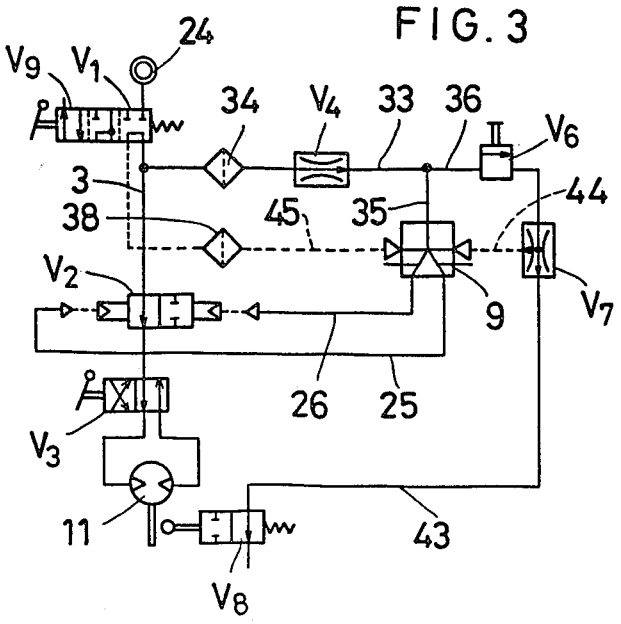
FIG. 3 is a circuit diagram.

FIG. 3 is a circuit diagram. The numeral 24 designates a compressed air source. Air source 24 communicates with the air passage 3 through the inlet valve $V_1$, the passage 3 in turn communicating with the main valve $V_2$ and the throttle valve $V_4$ through filter element 34. As shown in FIG. 2, the main valve $V_2$ is slidably fitted into a bushing 7 so as to be operable by air pressure applied to the diaphragms on both sides thereof. The main valve $V_2$ is adapted to permit the passage 3 and the switch valve V3 to communicate with or be shut off from each other. The outside of each of the diaphragms 8 communicates with each outlet of the said fluidic element 9 through pilot passages 25 and 26.

As shown in FIG. 3, the passage 33 having filter 34 and the throttle valve $V_4$ communicates with the inlet of a fluidic element 9 through a passage 35 and with a needle valve V6 through passage 36.

As shown in FIG. 2, the needle valve $V_6$ is operable manually and is provided with a passage 36 branching off intermediately from the passage 33. The passage 36 communicates with a conflux pipe (throttle valve) $V_7$ through a passage 43 provided in the center of the rotor of the air motor 11 and the anvil 16. In the middle part of the conflux pipe $V_7$, there is provided a small diameter hole 44 communicating with the right-hand control orifice of the fluidic element 9. The left-hand control orifice of the fluidic element 9 communicates with the pilot passage 45, a filter element 38 being provided in passage 45.

The operation of the apparatus according to the invention will now be described in detail. If the inlet valve $V_1$ is open by pressing the lever 4, while blocking communication between the air passage 3 and the pilot passage 45, compressed air from the compressed air source 24 flows into the passage 3 through the air inlet 2 and then into the air motor 11 through the main valve $V_2$ and the switch valve $V_3$ thereby rotating the rotor of the motor 11. Thus, the driver 18, the hammer frame 15, the anvil 16 and the torsion bar 17 are rotated, whereby the nut or the like is rotated by the socket mounted on the insertion part 20.

Part of the compressed air, after suitable pressure reduction by the throttle valve $V_4$, flows into the passages 33 and 35 or the passages 33 and 36 until it arrives at the input of the fluidic element 9 and the needle valve $V_6$, respectively. Part of the compressed air supplied the passage 3 through the inlet 2 when the slide shaft 5 is pushed downwardly by pressing the lever 4 instantaneously applies air pressure to the left-hand control orifice of the fluidic element 9 through the pilot passage 45, whereby the air supplied through the input of the fluidic element 9 applies pressure to the left-hand diaphragm 8 of the main valve $V_2$ through the right-hand outlet of fluidic element 9 and the pilot passage 25 to open the main valve $V_2$.

It is to be noted that the pipe line from $V_1$ to $V_7$ shown by a broken line in FIG. 3 is opened instantaneously in the course of the lever 4 being pressed, and closed when it is completely pressed.

The air supplied to the needle valve $V_6$ is discharged into the atmosphere via valve $V_6$, the conflux pipe $V_7$, the passage 43, the valve $V_8$ and the exhaust port 23 in that order. In this case, the small diameter part of the said conflux pipe $V_7$ has a negative pressure and the small diameter hole 44 also has negative pressure. Consequently, since the right-hand control orifice of the fluidic element 9 is free from pressure, the air supplied through the inlet of the fluidic element 9 continues applying pressure to the left-hand diaphragm 8 of the main valve $V_2$ even after the communication between the passage 3 and the pilot passage 45 has been cut off by the downward movement of the slide shaft 5.

Now, the fastening operation starts. When the rotation of the insertion part 20 of the torsion bar 17 is obstructed by the resistance of the nut or the like, the hammer 19 is brought into collision with the projection of the anvil 16 by the impact mechanism to exert a strong torque on torsion bar 17 since the air motor continues rotating. The torque causes the torsion bar 17 to be distorted.

In this state, the spindle case 21 alone rotates relative to the forward end of the torsion bar 17 inasmuch as spindle case 21 is free at its forward end relative to the torsion bar 17 though secured at its rearward end to the said torsion bar 17. Thus, the valve $V_8$ is angularly displaced from the exhaust port 23, thereby narrowing the opening in exhaust port 23. The exhaust port 23 is closed when the spindle case 21 rotates together with the twist of the torsion bar 17. When the exhaust port is closed, the air is no longer discharged and the flow of air inside the passage 43 is also suspended. Accordingly, negative pressure due to the air flow in the conflux pipe $V_7$ is no longer generated. To the contrary, the pressure in the conflux pipe V7 is elevated, and the air supplied from the needle valve $V_6$ is supplied to the right-hand control orifice of the fluidic element 9 through the small diameter hole 44. As a result, the direction of air flow in fluidic element 9 is changed. The air supplied to the inlet of fluidic element 9 flows to the left-hand outlet, thereby applying pressure to the right-hand diaphragm 8 of the main valve through the passage 26 to close valve $V_2$. Closing valve $V_2$ blocks the air directed to the air motor 11, whereby the air motor 11 is brought to a halt.

Since it is only in the instant of impact that the torsion bar 17 is twisted and the valve $V_8$ is closed, the elevation of pressure in the small diameter hole 44 is also instantaneous. Accordingly, immediately following the impact, the torsion bar 17 is restored to the untwisted state and remains such until the next moment of the impact. The main valve $V_2$ remains closed since the fluidic element 9 is as it stands, though the exhaust port 23 is left open. When the lever 4 is released from the manual pressure applied thereto, the valve $V_1$ is closed and the compressed air in the passage 3 flows to the left-hand control orifice of the fluidic element 9 through the pilot passage 45 instantaneously with the elevation of the slide shaft 5.

According to the invention, as described hereinbefore, the orifice-shaped valve $V_8$ of the spindle case 21 externally fitted onto the torsion bar 17 is closed or narrowed by the twisting of torsion bar 17 and the fluidic element 9 is actuated through the change of the air pressure resulting therefrom to redirect air there through to close the main valve $V_2$ and bring the air motor 11 to a halt. Thus, the possibility of errors arising in the fastening torque is minimized and the need for a complicated automatic valve is rendered unnecessary, whereby not only is the mechanism very much simplified but also the weight of the apparatus is reduced. Furthermore, the fastening torque can be freely changed by the control of the exhaust through the exhaust port 23 by means of the needle valve $V_6$ and the replacement of the torsion bar 17 and the spindle case 21. Particularly, according to the invention, a throttle valve $V_4$ is provided in the passage 33 branching off from the passage 3 which greatly stabilizes the air pressure supplied to the supply port of the fluidic element 9 from the passage 33 through the pilot passage 35. In addition, the main valve $V_2$ is adapted to be operated by the two diaphragms provided on the right-hand and left-hand sides of the main valve $V_2$, respectively, the two outputs of the fluidic element 9 being adapted to communicate with the two diaphragms 8, respectively, thereby enabling the main valve $V_2$ to operate smoothly in conformity with the change of the air flow of the fluidic element 9. Thus, the apparatus according to the invention has an advantage in that a more stabilized operation is obtainable compared with the case wherein springs are utilized in the main valve. It is needless to mention that the main valve $V_2$ may have a piston in place of the diaphragms 8.

I claim:

1. A pneumatic impact apparatus connected to a compressed air source, said apparatus comprising: a rotary air motor and means defining a first air passage connecting said air source and said motor;

a torsion bar having a first and a second end and connected at said first end to said motor for rotation therewith, said torsion bar having an exhaust passage directed through the side thereof at one of said first and second ends;

a spindle case having third and fourth ends surrounding said torsion bar and held at said third end to said torsion bar only at the other of said first and second ends for movement therewith, said fourth end of said spindle case being free for rotation with said other of said first and second ends of said torsion bar when a torque is applied to said first end of said torsion bar resisted by an external force at said second end, said spindle case having an exhaust passage opening to the atmosphere normally aligned with said exhaust passage of said torsion bar for allowing air to pass therethrough when said fourth end of said spindle case is rotating relative to said one of said first and second ends of said torsion bar out of alignment with said torsion bar;

a two-position main valve, located in said first air passage, for controlling the air flowing to said motor from the air source, said main valve including first and second diaphrams responsive to air pressure applied thereto, for respectively opening and closing said main valve to respectively allow and block the flow of air to said motor;

fluid control means, having a first inlet, first and second outlets and first and second control orifices, responsive to air pressure applied to said first and second control orifices for switching the flow of air entering said first inlet to said first and second outlets, respectively; said fluid control means having first and second pilot passages, said first and second outlets respectively communicating with said first and second diaphrams through said first and second pilot passages, respectively;

throttling valve means, having a second inlet, a third outlet communicating with said exhaust passage of said torsion bar, and a fourth outlet communicating with said second control orifice of said fluid control means, for controlling the flow of air from said second inlet to said exhaust passage of said torsion bar and for reducing the air pressure at said second control orifice to less than the air pressure at said second inlet;

control valve means, located in said first passage between said air source and said motor, for controlling air flow from the air source to said second inlet of said throttling means, said first inlet of said fluid control means, said first control orifice of said fluid control means and said motor, said control valve means having a third inlet in said first passage for communicating with the air source, a fifth outlet for communicating with said motor when said main valve is open, and a sixth outlet communicating with said first control orifice of said fluid control means, said control valve means being continuously moveable between first, second and third successively adjacent positions, said control valve means blocking communication between said third inlet and said fifth and sixth outlets in said first position, said fifth and sixth outlets communicating with said third inlet and with each other when said control valve means is in said second position, said third inlet communicating with said fifth outlet and said control valve means blocking communication between said fifth and sixth outlets and said third inlet, when said control valve means is in said third position said fifth outlet communicating with said second inlet of said throttling means and said first inlet of said fluid control means;

whereby when said control valve means is moved from said first to said second position, air pressure is applied through said control valve means to said first inlet and said first orifice of said fluid control means to direct air from said first inlet through said first outlet to apply pressure to said first diaphram to open said main valve so as to allow airflow to said air motor to drive said motor to apply torque to said torsion bar and said spindle case;

whereby when said control valve means is moved from said second position to said third position, air pressure to said first orifice of said fluid control means is cut off, airflow is directed through said throttling valve means to said torsion bar and through said exhaust passage, the air pressure at said second control orifice of said fluid control means being at a reduced value insufficient to switch the flow of air entering said first inlet of said fluid control means to said second outlet thereof so that air pressure on said first diaphram is maintained and said motor continues to be driven; and whereby if rotation of said torsion bar is blocked by an external force while said control valve means is in said third position, said fourth end of said spindle case is rotated relative to said one of said first and second ends of said torsion bar, whereby said exhaust passage of said spindle case is instantaneously closed so that airflow through said third outlet of said throttling valve means is interrupted so that air pressure at said second control orifice of said fluid control means is increased to switch the flow of air entering said first inlet of said fluid control means to said second outlet thereof, so that pressure to said second diaphram is applied to close said main valve to shut off said motor; return of said torsion bar to its normal position relative to said spindle case then opening said exhaust valve resulting in said main valve again opening to allow said motor to be driven by airflow from the air source.

2. A pneumatic impact apparatus as in claim 1, further comprising a dropping resistor for reducing the air pressure at said first inlet of said fluid control means, said fifth outlet of said control valve means communicating with said first inlet of said fluid control means through said dropping resistor.

3. A pneumatic impact apparatus as in claim 1, wherein said third end of said spindle case is held to said torsion bar for rotation therewith at said first end.

* * * * *